US008202587B2

(12) United States Patent
Wang

(10) Patent No.: US 8,202,587 B2
(45) Date of Patent: Jun. 19, 2012

(54) EDGE PROFILES FOR VACUUM INSULATED GLASS (VIG) UNITS, AND/OR VIG UNIT INCLUDING THE SAME

(75) Inventor: Hong Wang, Shanghai (CN)

(73) Assignee: Guardian Industries Corp., Auburn Hills, MI (US)

( * ) Notice: Subject to any disclaimer, the term of this patent is extended or adjusted under 35 U.S.C. 154(b) by 424 days.

(21) Appl. No.: 12/453,220

(22) Filed: May 1, 2009

(65) Prior Publication Data

US 2010/0279038 A1 Nov. 4, 2010

(51) Int. Cl.
*E06B 3/00* (2006.01)
*E04C 2/54* (2006.01)

(52) U.S. Cl. ..... 428/34; 428/192; 52/783.1; 52/786.13

(58) Field of Classification Search ..... 428/34, 428/192; 53/786.1, 786.13
See application file for complete search history.

(56) References Cited

U.S. PATENT DOCUMENTS

| | | | | |
|---|---|---|---|---|
| 5,657,607 | A | 8/1997 | Collins et al. | |
| 5,664,395 | A | 9/1997 | Collins et al. | |
| 5,902,652 | A | 5/1999 | Collins et al. | |
| 6,200,665 | B1 * | 3/2001 | Seto | 428/192 |
| 6,365,242 | B1 | 4/2002 | Veerasamy | |
| 6,383,580 | B1 | 5/2002 | Aggas | |
| 6,399,169 | B1 | 6/2002 | Wang et al. | |
| 6,444,281 | B1 | 9/2002 | Wang et al. | |
| 6,503,583 | B2 | 1/2003 | Nalepka et al. | |
| 6,541,083 | B1 | 4/2003 | Landa et al. | |
| 6,555,202 | B2 * | 4/2003 | Shukuri et al. | 428/156 |
| 6,635,321 | B2 | 10/2003 | Wang et al. | |
| 6,641,689 | B1 | 11/2003 | Aggas | |
| 6,692,600 | B2 | 2/2004 | Veerasamy et al. | |
| 6,701,749 | B2 | 3/2004 | Wang et al. | |
| 6,946,171 | B1 | 9/2005 | Aggas | |
| 7,244,480 | B2 | 7/2007 | Minaai et al. | |
| 2003/0108692 | A1 * | 6/2003 | Domi et al. | 428/34 |

FOREIGN PATENT DOCUMENTS

| | | |
|---|---|---|
| CA | 1 290 624 | 10/1991 |
| CN | 1128320 | 8/1996 |
| EP | 0 421 239 | 4/1991 |

* cited by examiner

*Primary Examiner* — Donald J Loney
(74) *Attorney, Agent, or Firm* — Nixon & Vanderhye P.C.

(57) ABSTRACT

Certain example embodiments of this invention relate to vacuum insulated glass (VIG) units. The VIG unit may comprise first and second substrates with inner and outer substantially planar surfaces. For either or both of the first and second substrates, when considered along a side cross-section, a portion of the inner planar surface is removed proximate to an outer edge of the glass substrate so as to form a shoulder portion. An inner surface of the shoulder portion is angled (a negative number of degrees, zero degrees, or a positive number of degrees) relative to the inner and outer planar surfaces. The shoulder portion at its smallest height is at least about 50% of the glass substrate at its largest height. A side portion of the step proximate the edge also may be angled, e.g., so that it is or is not perpendicular to the planar surfaces.

7 Claims, 9 Drawing Sheets

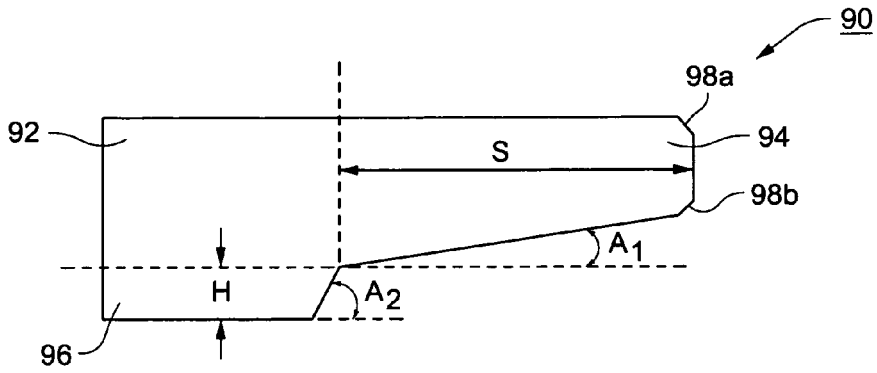
FIG. 9
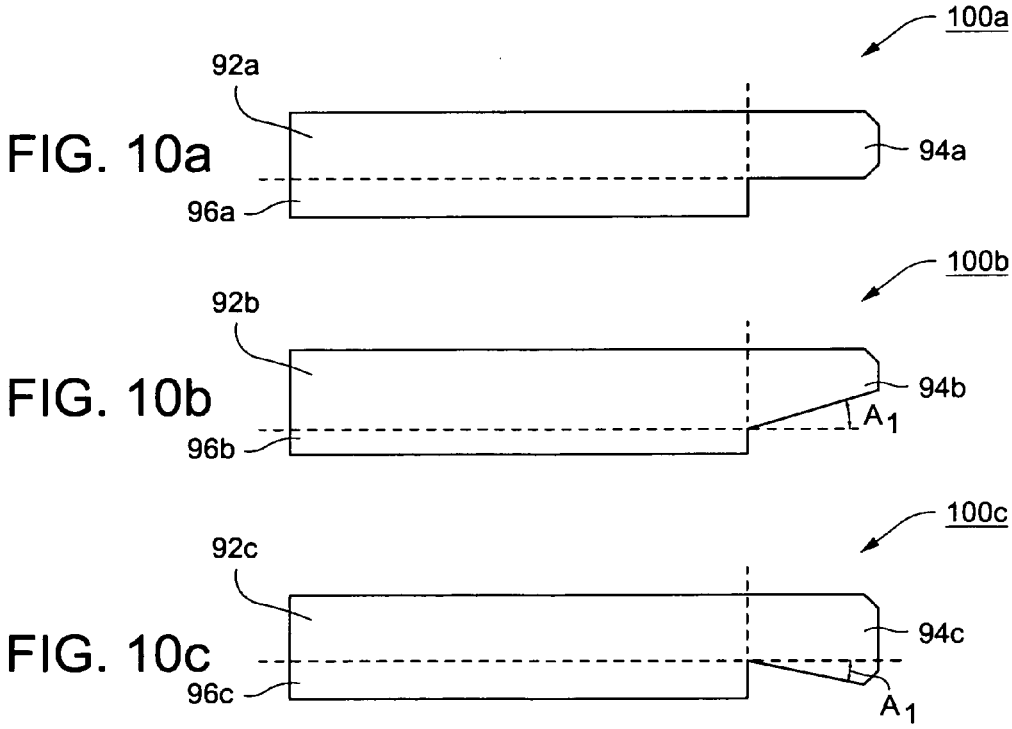
FIG. 10a
FIG. 10b
FIG. 10c

EDGE PROFILES FOR VACUUM INSULATED GLASS (VIG) UNITS, AND/OR VIG UNIT INCLUDING THE SAME

FIELD OF THE INVENTION

Certain example embodiments relate to glass edge profiles for vacuum insulated glass (VIG) units, e.g., for VIG units having two equally-sized lites. More particularly, certain example embodiments relate to VIG units where at least one lite thereof has a step feature at an edge thereof. The edge profiles of certain example embodiments are advantageous, for example, because they provide additional surface area to which the frit may attach, thereby improving edge seal quality. In addition, in certain example embodiments, depending on the shape of the edge profile, additional advantages such as easier frit application, better frit retention, etc., may be realized. Better frit retention, in turn, may be particularly advantageous with small capillary VIG unit designs and/or in applications where the glass surface is wetted, e.g., as are sometimes used with lead-free frits.

BACKGROUND AND SUMMARY OF EXAMPLE EMBODIMENTS OF THE INVENTION

Vacuum IG units are known in the art. For example, see U.S. Pat. Nos. 5,664,395, 5,657,607, and 5,902,652, the disclosures of which are all hereby incorporated herein by reference.

FIGS. 1-2 illustrate a conventional vacuum IG unit (vacuum IG unit or VIG unit). Vacuum IG unit 1 includes two spaced apart glass substrates 2 and 3, which enclose an evacuated or low pressure space 6 therebetween. Glass sheets/substrates 2 and 3 are interconnected by peripheral or edge seal of fused solder glass 4 and an array of support pillars or spacers 5.

Pump out tube 8 is hermetically sealed by solder glass 9 to an aperture or hole 10 which passes from an interior surface of glass sheet 2 to the bottom of recess 11 in the exterior face of sheet 2. A vacuum is attached to pump out tube 8 so that the interior cavity between substrates 2 and 3 can be evacuated to create a low pressure area or space 6. After evacuation, tube 8 is melted to seal the vacuum. Recess 11 retains sealed tube 8. Optionally, a chemical getter 12 may be included within recess 13.

Conventional vacuum IG units, with their fused solder glass peripheral seals 4, have been manufactured as follows. Glass frit in a solution (ultimately to form solder glass edge seal 4) is initially deposited around the periphery of substrate 2. The other substrate 3 is brought down over top of substrate 2 so as to sandwich spacers 5 and the glass frit/solution therebetween. The entire assembly including sheets 2, 3, the spacers, and the seal material is then heated to a temperature of approximately 500° C., at which point the glass frit melts, wets the surfaces of the glass sheets 2, 3, and ultimately forms hermetic peripheral or edge seal 4. This approximately 500° C. temperature is maintained for from about one to eight hours. After formation of the peripheral/edge seal 4 and the seal around tube 8, the assembly is cooled to room temperature. It is noted that column 2 of U.S. Pat. No. 5,664,395 states that a conventional vacuum IG processing temperature is approximately 500° C. for one hour. Inventors Lenzen, Turner and Collins of the '395 patent have stated that "the edge seal process is currently quite slow: typically the temperature of the sample is increased at 200° C. per hour, and held for one hour at a constant value ranging from 430° C. and 530° C. depending on the solder glass composition." After formation of edge seal 4, a vacuum is drawn via the tube to form low pressure space 6.

Unfortunately, the aforesaid high temperatures and long heating times of the entire assembly utilized in the formulation of edge seal 4 are undesirable, especially when it is desired to use a heat strengthened or tempered glass substrate(s) 2, 3 in the vacuum IG unit. As shown in FIGS. 3-4, tempered glass loses temper strength upon exposure to high temperatures as a function of heating time. Moreover, such high processing temperatures may adversely affect certain low-E coating(s) that may be applied to one or both of the glass substrates in certain instances.

FIG. 3 is a graph illustrating how fully thermally tempered plate glass loses original temper upon exposure to different temperatures for different periods of time, where the original center tension stress is 3,200 MU per inch. The x-axis in FIG. 3 is exponentially representative of time in hours (from 1 to 1,000 hours), while the y-axis is indicative of the percentage of original temper strength remaining after heat exposure. FIG. 4 is a graph similar to FIG. 3, except that the x-axis in FIG. 4 extends from zero to one hour exponentially.

Seven different curves are illustrated in FIG. 3, each indicative of a different temperature exposure in degrees Fahrenheit (° F.). The different curves/lines are 400° F. (across the top of the FIG. 3 graph), 500° F., 600° F., 700° F., 800° F., 900° F., and 950° F. (the bottom curve of the FIG. 3 graph). A temperature of 900° C. is equivalent to approximately 482° C., which is within the range utilized for forming the aforesaid conventional solder glass peripheral seal 4 in FIGS. 1-2. Thus, attention is drawn to the 900° F. curve in FIG. 3, labeled by reference number 18. As shown, only 20% of the original temper strength remains after one hour at this temperature (900° F. or 482° C.). Such a significant loss (i.e., 80% loss) of temper strength is of course undesirable.

In FIGS. 3-4, it is noted that much better temper strength remains in a thermally tempered sheet when it is heated to a temperature of 800° F. (about 428° C.) for one hour as opposed to 900° F. for one hour. Such a glass sheet retains about 70% of its original temper strength after one hour at 800° F., which is significantly better than the less than 20% when at 900° F. for the same period of time.

Another advantage associated with not heating up the entire unit for too long is that lower temperature pillar materials may then be used. This may or may not be desirable in some instances.

Even when non-tempered glass substrates are used, the high temperatures applied to the entire VIG assembly may soften the glass or introduce stresses, and partial heating may introduce more stress. These stresses may increase the likelihood of deformation of the glass and/or breakage.

Moreover, the ceramic or solder glass edge seals of conventional VIG units tend to be brittle and prone to cracking and/or breakage, reducing the ability of individual glass panels to move relative to one another. Glass panel movement is known to occur under normal conditions such as, for example, when two hermetically sealed glass components (such as in a VIG unit) are installed as a component of a window, skylight or door, whereby the VIG unit is exposed to direct sunlight and one glass panel has higher thermal absorption than the other panel or there is a great difference between the interior and exterior temperatures.

FIG. 5 is an example conventional VIG unit. In the FIG. 5 VIG unit, first and second glass substrates 2 and 3 with flat edges are used, with the first substrate 2 being slightly smaller than the second substrate 3. The offset typically is about 3-4 mm around the glass perimeter. This design allows the glass frit 4 to be easily applied to the edges in an open environment.

The bonding between the frit 4 and the first substrate 2 mainly occurs on two surfaces, namely, the lower surface 2*a* and the side surface 2*b* of the first substrate 2. There also is some bonding on the small seamed surface 2*c* at the corner of the first substrate 2. The slanting main body portion 4*a* of the glass frit 4 helps retain the frit effectively, with a portion 4*b* of the frit being allowed to flow into the gap 6 between the first and second substrates 2, 3 by capillary force. Unfortunately, the weight is loaded on the larger second substrate 3 when the unit is installed vertically, putting the larger second substrate 3 under a higher stress in comparison to the VIG unit designs where equally-sized substrates are used. In addition, when the frit is in a small capillary, the edge seal tends be narrow and thus weak.

Chinese Patent Application No. 95108228.0B (which is hereby incorporated herein by reference) discloses several equal-size substrate designs. For example, in FIG. 6, the first and second substrates are equally sized. The second substrate 3 has a flat inner surface 3*a*, whereas the first substrate 2 has an angled end portion 2*c*. The FIG. 6 design is desirable from aesthetic and stress loading points of view. As in the offset design described above, the frit 4 flows between the first and second substrates 2, 3 by capillary force. However, when the capillary is small, the edge seal will be formed generally on only a single surface.

FIGS. 7-8 show yet further prior art VIG edge seal designs. For example, FIG. 7 shows a VIG unit having angled top and bottom substrates 2, 3, while FIG. 8 shows a VIG unit having rounded top and bottom substrates 2, 3. In both cases, it would be difficult to retain the frit 4 unless some additional techniques are used to hold the molten frit in place, e.g., during the firing process.

In view of the above, it will be appreciated that there is a need in the art for a vacuum IG unit, and corresponding method of making the same, where a structurally sound hermetic edge seal may be provided between opposing glass sheets. There also exists a need in the art for a vacuum IG unit including tempered glass sheets, wherein the peripheral seal is formed such that the glass sheets retain more of their original temper strength than with a conventional vacuum IG manufacturing technique where the entire unit is heated in order to form a solder glass edge seal.

Certain example embodiments of this invention relate to a vacuum insulated glass (VIG) unit. First and second substantially parallel spaced apart substrates are provided. The first and second substrates form a cavity therebetween. An edge seal is located around the periphery of the first and second substrates. The first substrate, when viewed along a side cross-section, comprises a body portion. A step portion extends a step height H into the cavity from a major axis of the body portion, with an outer edge of the step portion being setback at least a setback distance S from an outer edge of the VIG unit. At least one protrusion extends from the minor axis of the body portion towards one edge of the VIG unit, with the length of the protrusion corresponding to the setback distance S.

Certain example embodiments of this invention relate to a vacuum insulated glass (VIG) unit. First and second substantially parallel spaced apart substrates are provided. The first and second substrates form a cavity therebetween. An edge seal is located around the periphery of the first and second substrates. The first substrate, when viewed along a side cross-section, comprises a first body portion. A first step portion extends a height H1 into the cavity from a major axis of the first body portion, with an outer edge of the first step portion being setback at least a setback distance S1 from an outer edge of the VIG unit. At least one first protrusion extends from the minor axis of the first body portion towards one edge of the VIG unit, with the length of the first protrusion corresponding to the setback distance S1. The second substrate, when viewed from along a side cross-section, comprises a second body portion. A second step portion extends a height H2 into the cavity from a major axis of the second body portion, with an outer edge of the second step portion being setback at least a setback distance S2 from an outer edge of the VIG unit. At least one second protrusion extends from the minor axis of the second body portion towards one edge of the VIG unit, with the length of the second protrusion corresponding to the setback distance S2.

Certain example embodiments of this invention relate to a glass substrate for use in a VIG unit, comprising inner and outer substantially planar surfaces. When considered along a side cross-section, a portion of the inner planar surface is removed proximate to an outer edge of the glass substrate so as to form a shoulder portion. An inner surface of the shoulder portion is angled relative to the inner and outer planar surfaces. The shoulder portion at its smallest height is at least about 50% of the glass substrate at its largest height.

Certain example embodiments of this invention relate to a method of making a vacuum insulated glass (VIG) unit. First and second glass substrates comprising respective inner and outer substantially planar surfaces are provided. When the first and/or second substrates are considered along side cross-section(s), a portion of the inner planar surface is removed proximate to an outer edge of the glass substrate so as to form a shoulder portion, an inner surface of the shoulder portion is angled relative to the inner and outer planar surfaces, and the shoulder portion at its smallest height is at least about 50% of the glass substrate at its largest height. Edges of the first and second substrates are sealed using a frit material in making the VIG unit.

The features, aspects, advantages, and example embodiments described herein may be combined to realize yet further embodiments.

BRIEF DESCRIPTION OF THE DRAWINGS

These and other features and advantages may be better and more completely understood by reference to the following detailed description of exemplary illustrative embodiments in conjunction with the drawings, of which:

FIG. 9 is a generalized view of edge profiles according to certain example embodiments of this invention;

FIG. 10*a* is an illustrative "flat with step" edge profile in accordance with certain example embodiments;

FIG. 10*b* is an illustrative "beveled with step" edge profile in accordance with certain example embodiments;

FIG. 10*c* is an illustrative "reverse beveled with step" edge profile in accordance with certain example embodiments;

DETAILED DESCRIPTION OF EXAMPLE EMBODIMENTS OF THE INVENTION

Figure 2:
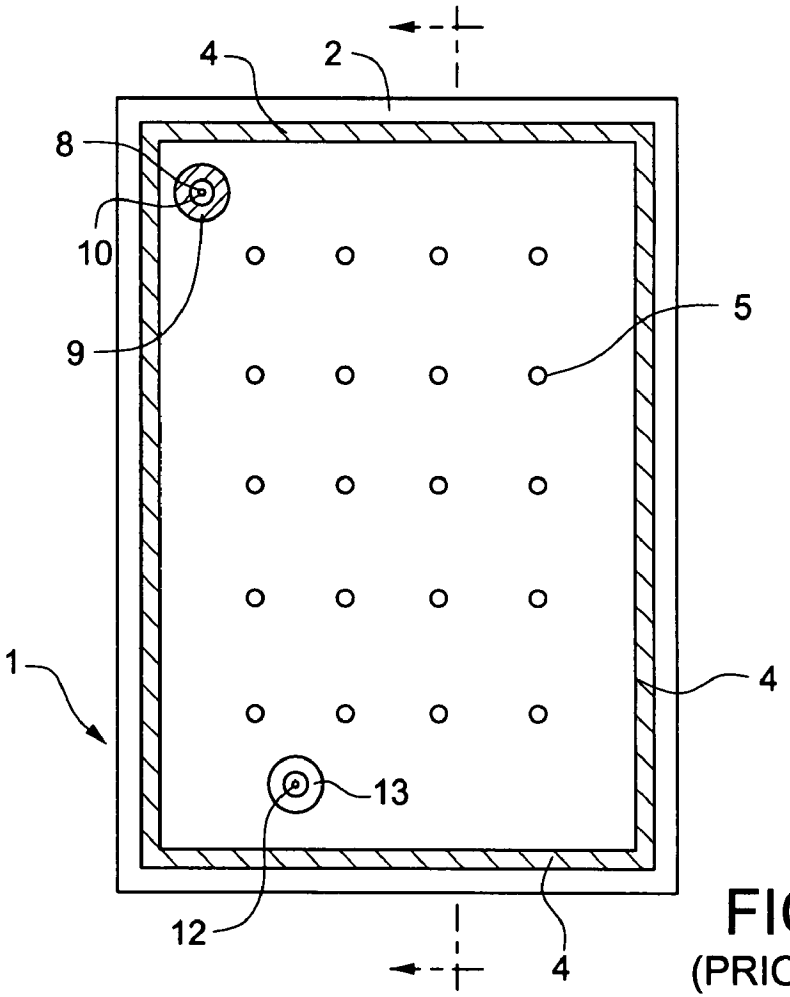
FIG. 2 (PRIOR ART)
FIG. 2 is a prior art top plan view of the bottom substrate, edge seal, and spacers of the FIG. 1 vacuum IG unit taken along the section line illustrated in FIG. 1.
Figure 1:
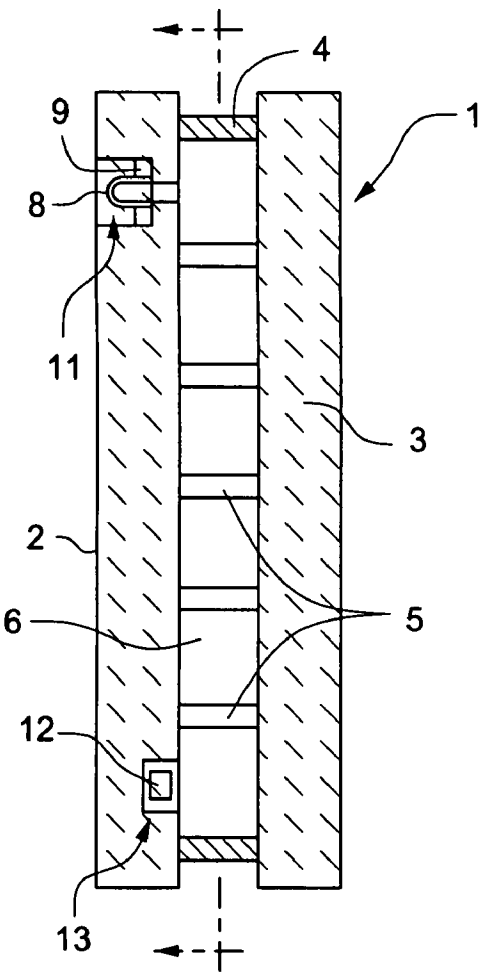
FIG. 1 (PRIOR ART)
FIG. 1 is a prior art cross-sectional view of a conventional vacuum IG unit.
Figure 3:
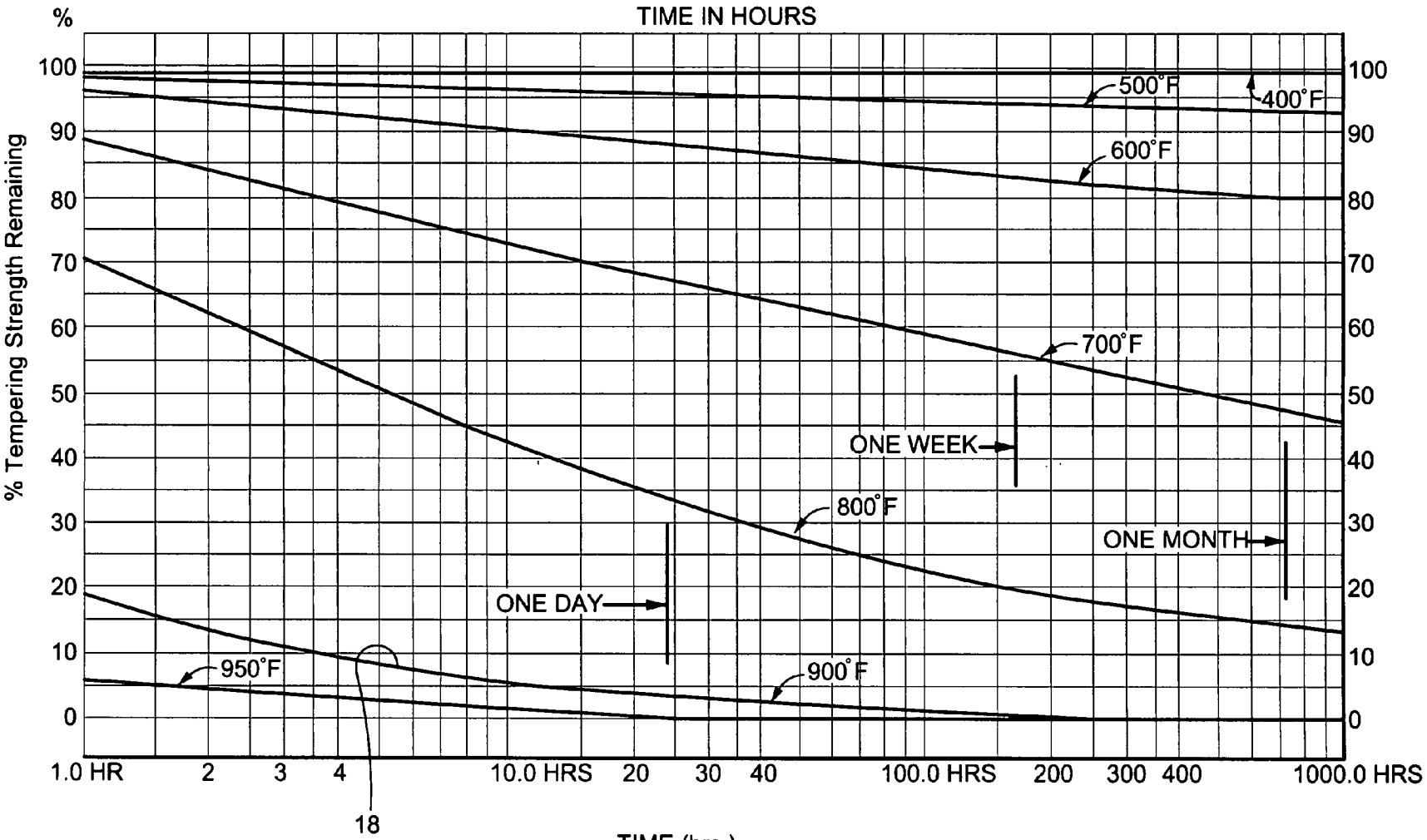
FIG. 3 is a graph correlating time (hours) versus percent tempering strength remaining, illustrating the loss of original temper strength for a thermally tempered sheet of glass after exposure to different temperatures for different periods of time.
Figure 4:
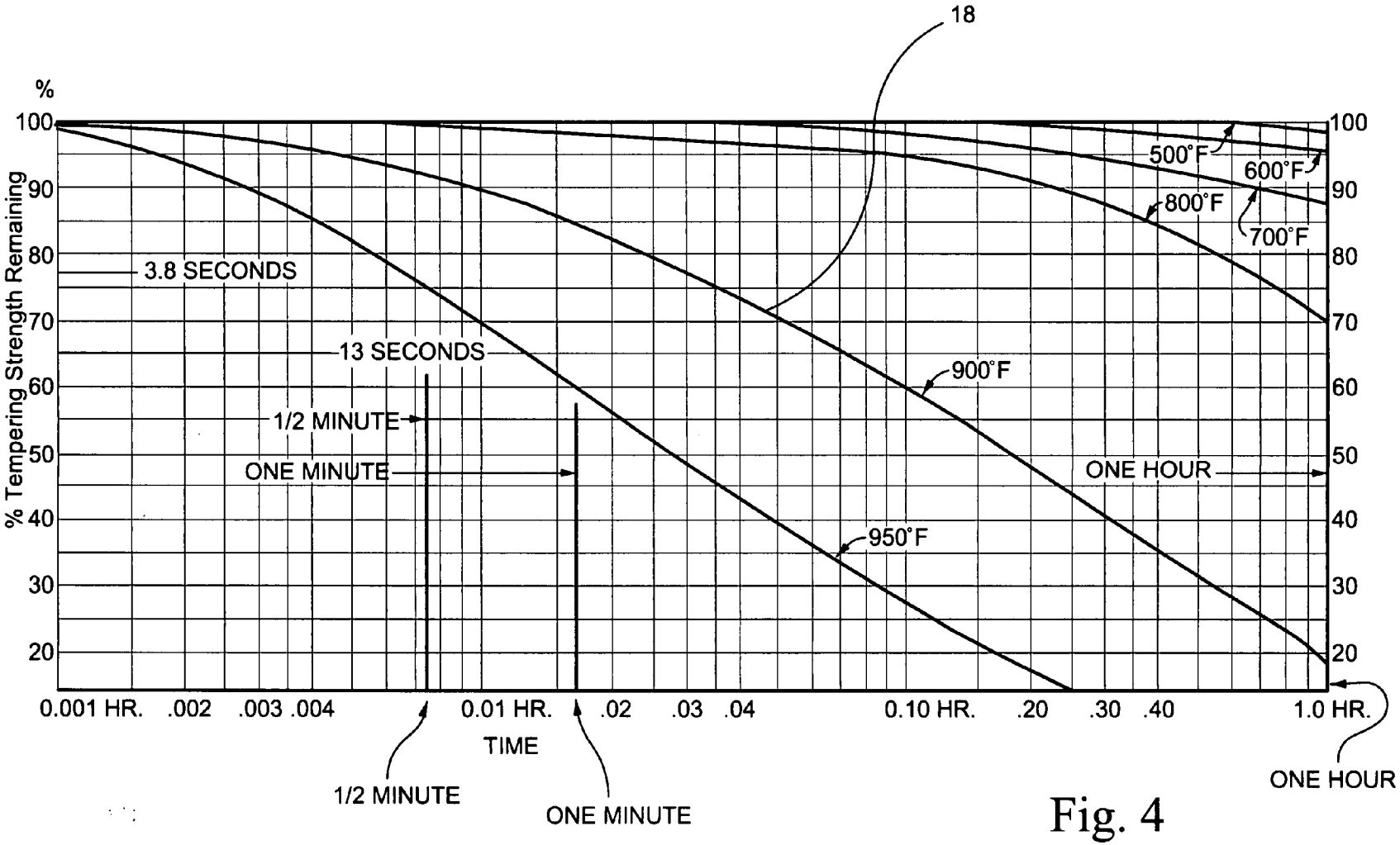
FIG. 4 is a graph correlating time versus percent tempering strength remaining similar to that of FIG. 3, except that a smaller time period is provided on the x-axis.
Figure 5:
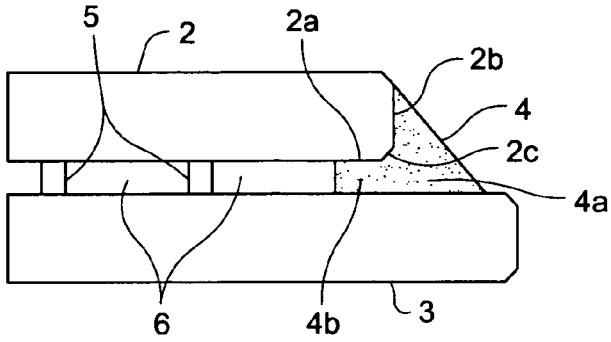
FIG. 5 (Prior Art)
FIGS. 5-8 are example prior art VIG unit designs.
Figure 6:
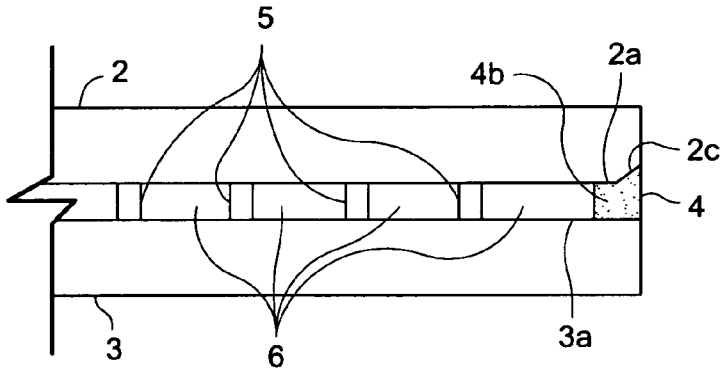
FIG. 6 (Prior Art)
Figure 7:
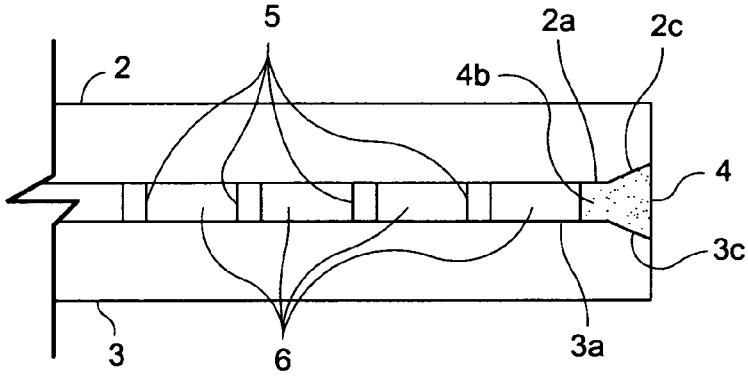
FIG. 7 (Prior Art)
Figure 8:
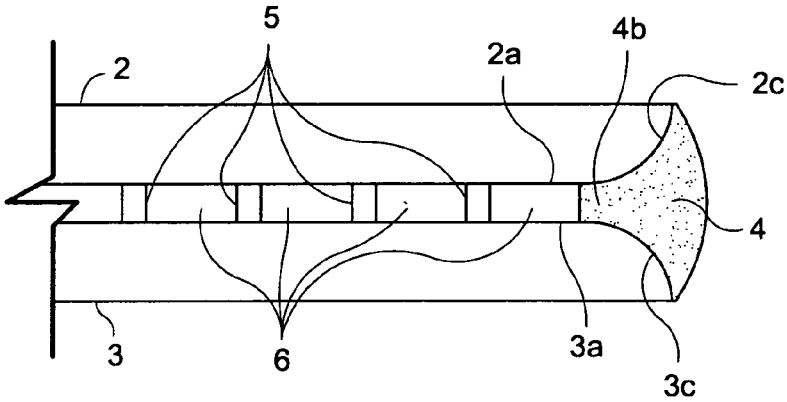
FIG. 8 (Prior Art)

Certain embodiments of this invention relate to an improved peripheral or edge seal in a vacuum IG window unit, and/or a method of making the same. "Peripheral" and "edge" seals herein do not mean that the seals are located at the absolute periphery or edge of the unit, but instead mean that the seal is at least partially located at or near (e.g., within about two inches) an edge of at least one substrate of the unit. Likewise, "edge" as used herein is not limited to the absolute edge of a glass substrate but also may include an area at or near (e.g., within about two inches) of an absolute edge of the substrate(s). Also, it will be appreciated that as used herein the term "VIG assembly" refers to an intermediate product prior to the VIG's edges being sealed and evacuation of the recess including, for example, two parallel-spaced apart substrates. Also, while a component may be said to be "on" or "supported" by one or more of the substrates herein, this does not mean that the component must directly contact the substrate(s). In other words, the word "on" covers both directly and indirectly on, so that the component may be considered "on" a substrate even if other material (e.g., a coating and/or thin film) is provided between the substrate and the component.

Certain example embodiments relate to glass edge profiles for vacuum insulated glass (VIG) units, e.g., for VIG units having two equally-sized lites. More particularly, certain example embodiments relate to VIG units where at least one lite thereof has a step feature at an edge thereof. The edge profiles of certain example embodiments are advantageous, for example, because they provide additional surface area to which the frit may attach, thereby improving edge seal quality. In addition, in certain example embodiments, depending on the shape of the edge profile, additional advantages such as easier frit application, better frit retention, etc., may be realized. Better frit retention, in turn, may be particularly advantageous with small capillary VIG unit designs and/or in applications where the glass surface is wetted, e.g., as are sometimes used with lead-free frits.

"Edge profile" as used herein refers to the shape of a substrate along an edge and proximate to a perimeter thereof. Although the drawings discussed in further detail below include cross-sectional side views of the substrates and only a single edge thereof, it will be appreciated that the edge profiles may be formed on opposing sides or around the entire substrate in certain example embodiments of this invention. Additionally, although certain substrates are identified as being "top" or "upper" or "bottom" or "lower" substrates, unless explicitly stated, the positions of the substrates may be reversed, e.g., such that either substrate may be used as the interior or exterior lite in the VIG assembly. Furthermore, although certain example embodiments are described as relating to VIG units with "equally sized lites," it will be appreciated that the two substrates provided in the VIG unit are not necessarily the exact same size and shape. Rather, it is understood that two substrates technically may be differently sized and/or shaped and still be considered "equally sized lites," provided that they are approximately the same size, particularly with respect to the outermost length and width dimensions. In other words, it is understood that two substrates may be considered "equally sized lites" when they have the approximate same length and width dimensions, notwithstanding any step, protrusion, or shoulder portions (e.g., as described below).

Certain example embodiments of this invention relate to glass edge designs for VIG units with equally-sized lites. Although FIGS. 10*a-c* show edge profiles according to example embodiments of this invention, such edge profiles can be generalized, e.g., as shown in FIG. 9, with the common feature of a step. The shape of the edge can be varied by changing parameters such as, for example, setback distance S, step height H, step angle A2, and bevel angle A1. For example, depending on the bevel angle range (zero, positive, or negative), the design can also be grouped as flat with a step (FIG. 10*a*, for example), beveled with a step (FIG. 10*b*, for example), or reverse beveled with a step (FIG. 10*c*, for example). Such example embodiments are advantageous for a number of reasons. For example, the common feature of a step offers the advantage of an extra surface for the frit to grasp onto, thereby improving the quality of the edge seal. Additionally, the flat with step edge profile offers a wider gap for easy frit application. The beveled with step edge profile offers a yet wider opening for easy frit application. The reverse bevel with step edge profile is advantageous in that it provides for a significant improvement in frit retention, which can be of particular value, for example, in connection with small capillary VIG unit designs and/or in applications where the glass surface is wetted, e.g., as are sometimes used with lead-free frits. These example edge seal profiles may be combined in various combinations and sub-combinations to realize advantageous aspects of the various designs as shown and explained in greater detail below.

Bevel angle A1 may range between about −89 degrees and +89 degrees, more preferably between about −60 degrees and +60 degrees, still more preferably between about −30 degrees and +30 degrees, although other ranges and sub-ranges also are possible in different embodiments. Step angle A2 may range between about 1-179 degrees, more preferably between about 30-90 degrees, and still more preferably between about 45-90 degrees, although other ranges and sub-ranges also are possible in different embodiments. The step height H preferably is less than 50% the height of the body portion, more preferably less than 33% of the height of the body portion, and sometimes even less than 25% of the height of the body portion.

In other words, a VIG unit according to an example embodiment may comprise first and second substrates with inner and outer substantially planar surfaces. For either or both of the first and second substrates, when considered along a side cross-section, a portion of the inner planar surface is removed proximate to an outer edge of the glass substrate so as to form a shoulder portion. An inner surface of the shoulder portion is angled (a negative number of degrees, zero degrees, or a positive number of degrees) relative to the inner and outer planar surfaces. The shoulder portion at its smallest height is at least about 50% of the glass substrate at its largest height. A side portion of the step proximate the edge also may be angled, e.g., so that it is or is not perpendicular to the planar surfaces.

As indicated above, FIG. 9 is a generalized view of edge profiles according to certain example embodiments of this invention. The edge profile 90 of FIG. 9 has a main body portion 92, which is setback from the outermost edge of the lite by a setback distance S so as to form a protrusion 94. The bottom surface of the protrusion 94 may be angled with respect to a line extending horizontally along the bottom surface of the body portion 92. As explained in greater detail below, this bevel angle A1 may be zero degrees, a positive number of degrees, or a negative number of degrees. The bevel angle A1 in FIG. 9 is a positive number of degrees. Thus, the distance between the bottom surface of the protrusion 94 and the line extending horizontally along the bottom surface of the body portion 92 (and the lite itself) is the greatest when it is the closest to the outer edge of the lite, and the distance becomes smaller moving closer to the interior of the lite. A step 96 also extends from a bottom surface of the body portion 92 a distance or step height H. Similar to the protrusion 94, the step 96 may be angled. In particular, the step 96 may be angled with respect to a line extending horizontally along the bottom surface of the step 96, e.g., such that the step angle A2 between outermost edge of the step 96 and the line extending horizontally along the bottom surface of the step 96 is an acute angle (as shown in FIG. 9, for example), a right angle (as shown in FIG. 10*a*, for example), or an obtuse angle. The protrusion 94 also may have angled edge portions 98*a-b* along the outer edges thereof.

FIG. 10*a* is an illustrative "flat with step" edge profile 100*a* in accordance with certain example embodiments. FIG. 10*a* is similar to FIG. 9 in that the lite includes a main body portion 92*a* with a protrusion 94*a* and a step 96*a*. However, in the FIG. 10*a* example, the bevel angle is zero degrees, and the step angle is 90 degrees. Thus, the bottom surface of the protrusion 94*a* is in line with the bottom of the body portion 92*a*, and the outer vertical edge of the step 96*a* is perpendicular to the bottom surface of the step 96*a*. This arrangement creates a substantially rectangular opening in which frit material can be applied, as explained in greater detail below.

FIG. 10*b* is an illustrative "beveled with step" edge profile 100*b* in accordance with certain example embodiments. FIG. 10*b* is similar to FIG. 9 in that the lite includes a main body portion 92*b* with a protrusion 94*b* and a step 96*b*. Like FIG. 9, the bevel angle A1 is a positive number of degrees, thus making the distance between the bottom surface of the protrusion 94*b* and the line extending horizontally along the bottom surface of the body portion 92*b* (or the lite itself) greatest when it is closest to the edge and smallest closer to the interior of the lite. The step angle is 90 degrees, thus making the outer vertical edge of the step 96*b* perpendicular to the bottom surface of the step 96*b*. This arrangement creates a substantially trapezoidal opening in which frit material can be applied, as explained in greater detail below, with the smaller base being formed along the innermost vertical edge of the step 96*b* and the larger base being formed along the outermost vertical edge of the protrusion 94*b*.

FIG. 10*c* is an illustrative "reverse beveled with step" edge profile 100*c* in accordance with certain example embodiments. FIG. 10*c* is similar to FIG. 10*b*, except that the bevel angle A1 is a negative number of degrees. Thus, the distance between the bottom surface of the protrusion 94*c* and a line extending along the bottom surface of the step 96*c* the smallest when it is closest to the outer edge of lite, and the distance becomes greater when it is closer to the interior of the lite. The step angle is 90 degrees, thus making the outer vertical edge of the step 96*c* perpendicular to the bottom surface of the step 96*c*. This arrangement creates a substantially trapezoidal opening in which frit material can be applied, as explained in greater detail below, with the larger base being formed along the innermost vertical edge of the step 96*b* and the smaller base being formed along the outermost vertical edge of the protrusion 94*b*.

It will be appreciated that the lites of certain example embodiments may be formed via any suitable process. For example, the edge profiles of certain example embodiments may be formed on a single, unitary piece of glass, e.g., by milling, grinding, drilling (e.g., with a chuck), etc. Such processes may be performed in a single or in multiple steps in certain example embodiments (e.g., a first process may be used to form the step, a second step may be used to form the step angle, a third step may be used to form the bevel angle, etc.).

Figure 11:
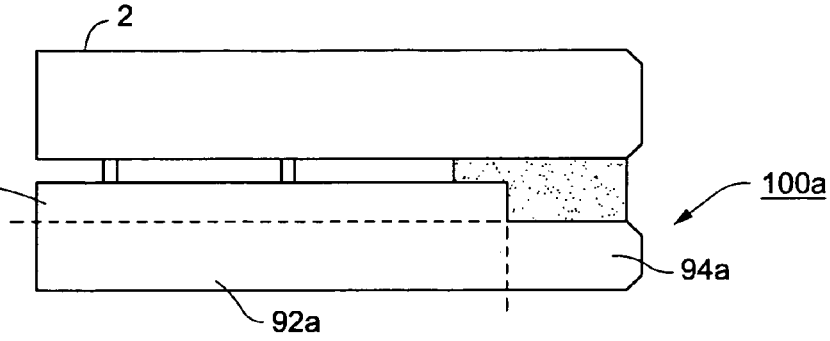
FIG. 11 shows a top flat glass lite being provided in spaced-apart relation to a bottom lite having a "flat with step" edge profile in accordance with certain example embodiments.
Figure 12:
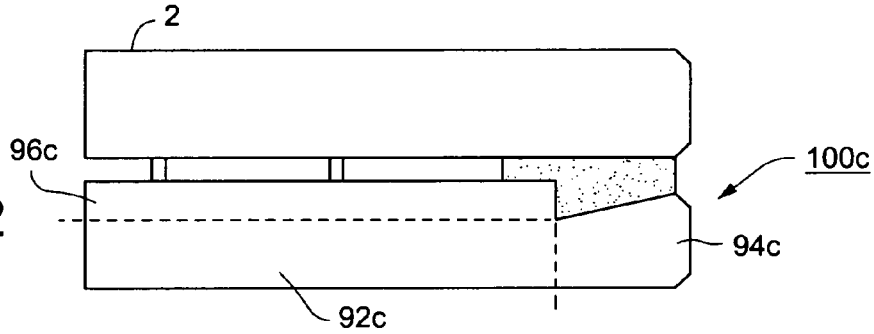
FIG. 12 shows a top flat glass lite provided in spaced-apart relation to a bottom lite having a "reverse beveled with step" edge profile in accordance with certain example embodiments.

As noted above, the example edge seal profiles may be combined in various combinations and sub-combinations to realize advantageous aspects of the various designs. In this regard, FIGS. 11-23 show various example combinations and sub-combinations of such example edge seal profiles. In each of these examples, the frit is applied at the periphery of the substrates such that a portion thereof ultimately is formed on the step portion(s) and in a portion of the cavity defined between the opposing substrates. FIG. 11 shows a top flat glass lite 2 being provided in spaced-apart relation to a bottom lite having a "flat with step" edge profile 100*a* in accordance with certain example embodiments, and FIG. 15 shows a bottom flat glass lite 3 being provided in spaced-apart relation to a top lite having a "flat with step" edge profile 100*a* in accordance with certain example embodiments. FIG. 12 similarly shows a top flat glass lite 2 provided in spaced-apart relation to a bottom lite having a "reverse beveled with step" edge profile 100*c* in accordance with certain example embodiments.

Figure 13:
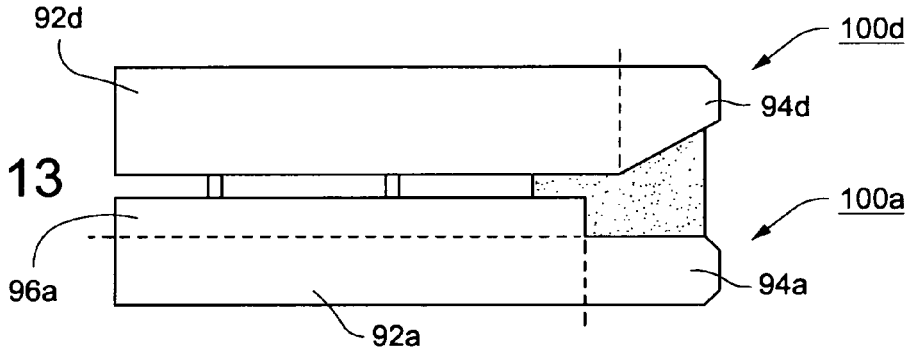
FIG. 13 shows a top lite with an angled edge profile and a bottom lite with a "flat with step" edge profile in accordance with certain example embodiments.
Figure 14:
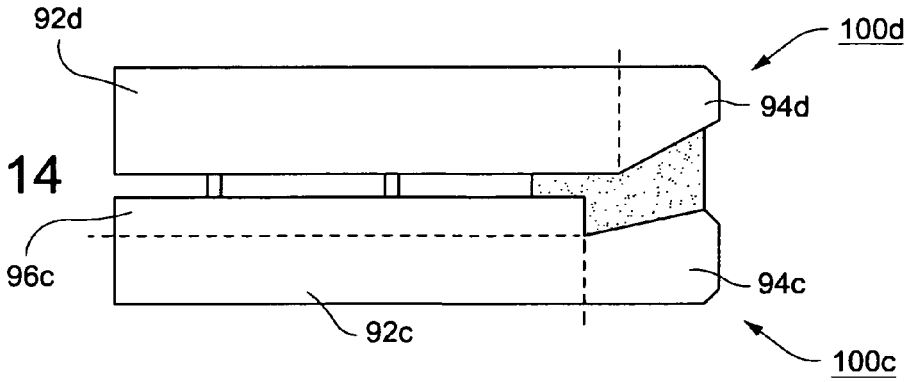
FIG. 14 shows a top lite with an angled edge profile and a bottom lite with a "reverse bevel with step" edge profile in accordance with certain example embodiments.
Figure 15:
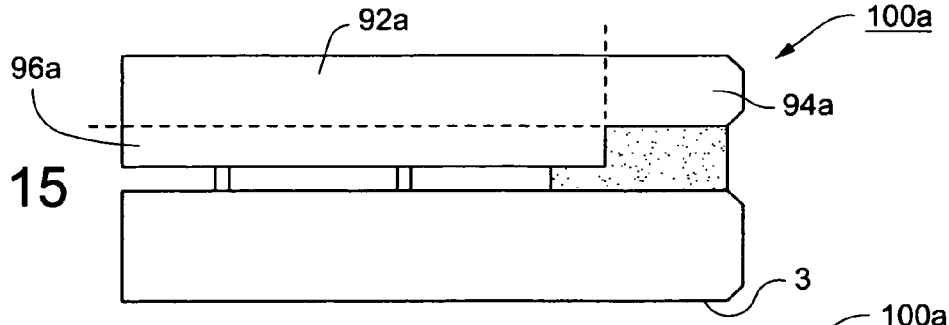
FIG. 15 shows a bottom flat glass lite being provided in spaced-apart relation to a top lite having a "flat with step" edge profile in accordance with certain example embodiments.

FIGS. 13 and 14 both show lites with angled edge profiles 100*d*. In particular, FIG. 13 shows a top lite with an angled edge profile 100*d* and a bottom lite with a "flat with step" edge profile 100*a* in accordance with certain example embodiments, and FIG. 14 shows a top lite with an angled edge profile 100*d* and a bottom lite with a "reverse bevel with step" edge profile 100*c* in accordance with certain example embodiments. It will be appreciated that the amount of the setback may be the same as or different from the length of the protrusion 94*d*. It also will be appreciated that the angle of the protrusion 94*d* may be the same as or different from the bevel angle of the edge profile 100*c*.

Figure 16:
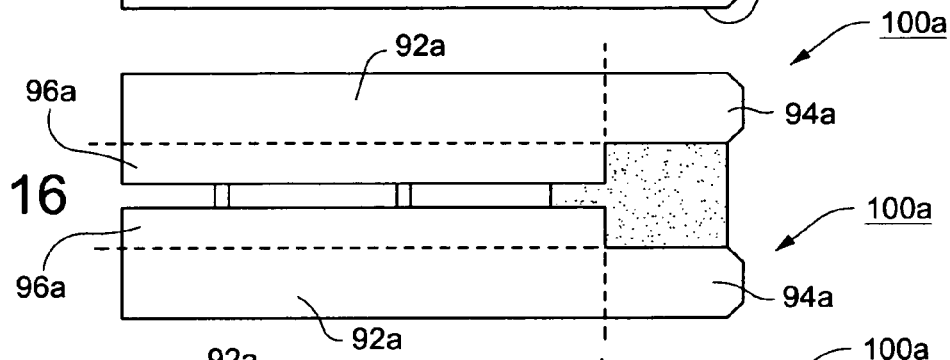
FIG. 16 shows an example configuration in which both the top and bottom lites have "flat with step" edge profile in accordance with certain example embodiments.
Figure 17:
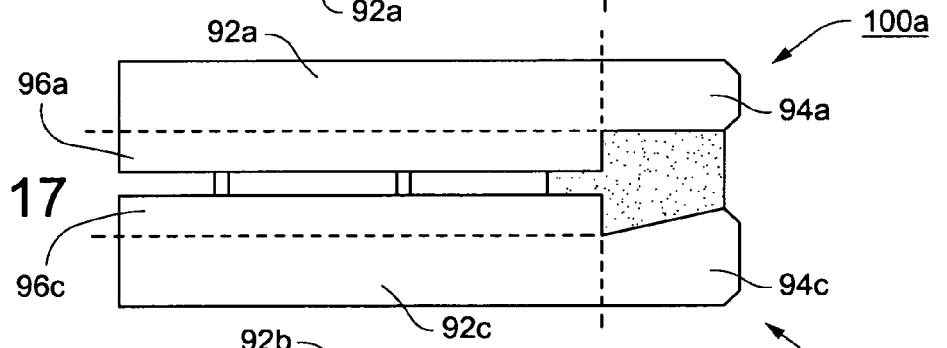
FIG. 17 shows a top lite with a "flat with step" edge profile and a bottom lite with a "reverse bevel with step" edge profile in accordance with certain example embodiments.

FIGS. 16 and 17 both show lites with "flat with step" edge profiles 100*d*. In particular, FIG. 16 shows an example configuration in which both the top and bottom lites have "flat with step" edge profile 100*a* in accordance with certain example embodiments, and FIG. 17 shows a top lite with a "flat with step" edge profile 100*a* and a bottom lite with a "reverse bevel with step" edge profile 100*c* in accordance with certain example embodiments. As above, it will be appreciated that the setbacks may be the same or different for the two lites. It will be appreciated that positions of the two lites may be reversed in connection with FIG. 17, e.g., such that the top lite has a "reverse bevel with step" edge profile 100*c* whereas the bottom lite has a "flat with step" edge profile 100*a*.

Figure 18:
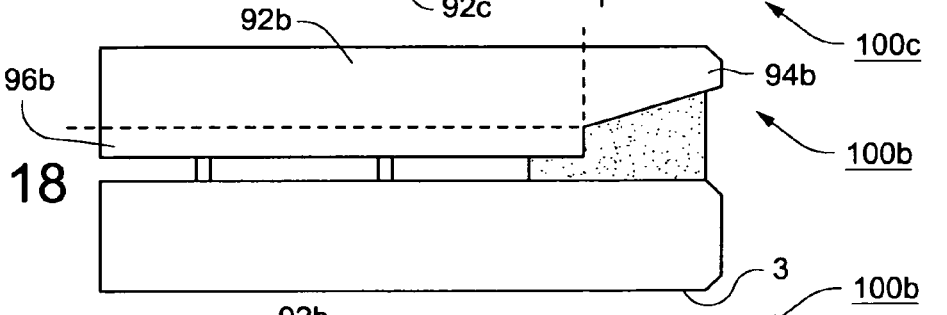
FIG. 18 shows a top lite with a "beveled with step" edge profile and a flat bottom substrate in accordance with certain example embodiments.
Figure 19:
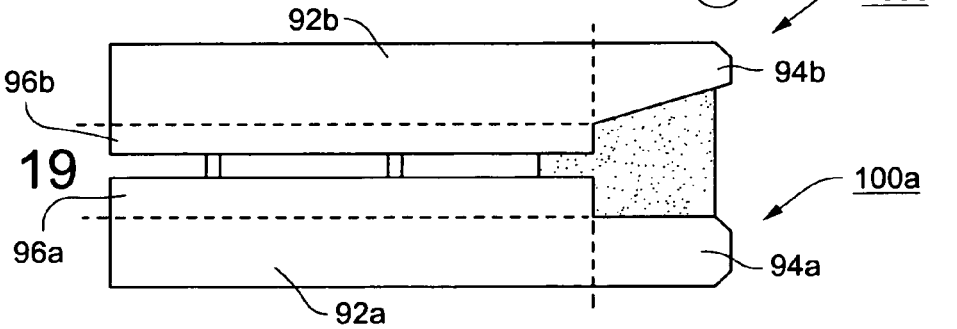
FIG. 19 shows a top lite with a "beveled with step" edge profile and a bottom lite in accordance with certain example embodiments.
Figure 20:
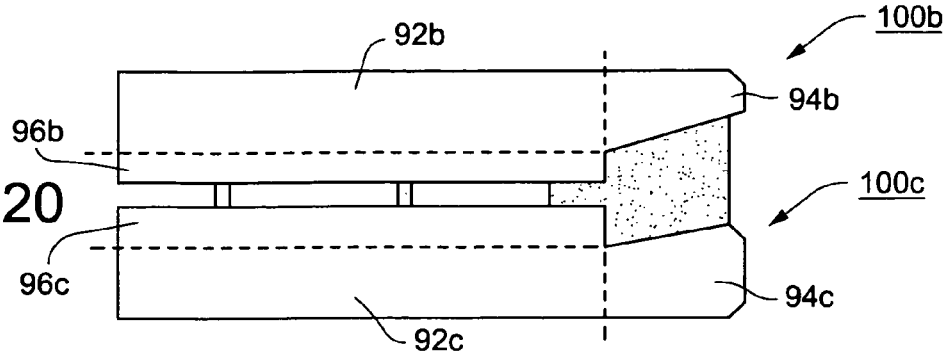
FIG. 20 shows a top lite with a "beveled with step" edge profile and a bottom lite with a "reverse bevel with step" edge profile in accordance with certain example embodiments.

FIGS. 18-20 each show upper lites having "beveled with step" edge profiles 100*b*. In particular, FIG. 18 shows a top lite with a "beveled with step" edge profile 100*b* and a flat bottom substrate 3 in accordance with certain example embodiments, FIG. 19 shows a top lite with a "beveled with step" edge profile 100*b* and a bottom lite with a "flat with step" edge profile 100*a* in accordance with certain example embodiments, and FIG. 20 shows a top lite with a "beveled with step" edge profile 100*b* and a bottom lite with a "reverse bevel with step" edge profile 100*c* in accordance with certain example embodiments. It will be appreciated that the setbacks for the lites shown in FIGS. 18 and 20 may be the same or different in certain example embodiments. Additionally, it will be appreciated that the bevel angles in FIG. 20 may be inverses with one another, or may be otherwise different from each other. As above, the lites in each of FIGS. 18-20 may be interchanged, e.g., such that the top lites illustrated in the examples are the bottom lites in yet further examples, and vice versa.

Figure 21:
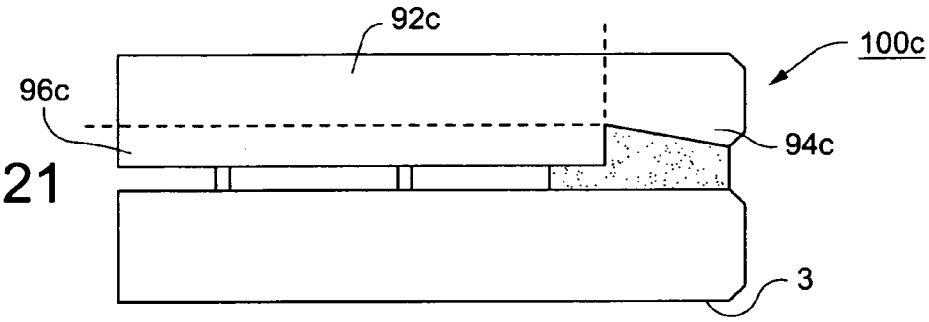
FIG. 21 shows a top lite with a "reverse bevel with step" edge profile and a flat bottom substrate in accordance with certain example embodiments.
Figure 22:
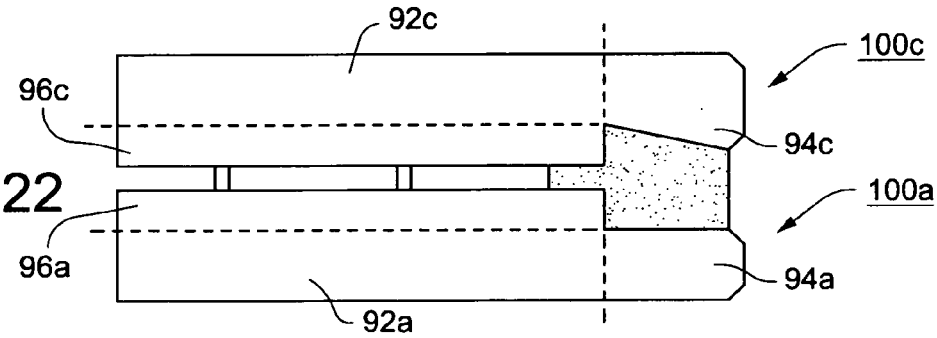
FIG. 22 shows a top lite with a "reverse bevel with step" edge profile and a bottom lite that has a "flat with step" edge profile in accordance with certain example embodiments.
Figure 23:
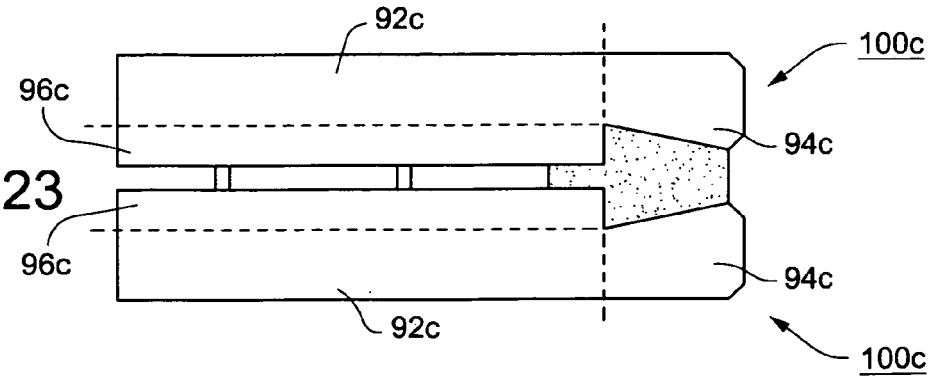
FIG. 23 shows an example arrangement in which both the top and bottom lites have a "reverse bevel with step" edge profile in accordance with certain example embodiments.

FIGS. 21-23 each show upper lites having "reverse bevel with step" edge profiles 100*c*. In particular, FIG. 21 shows a top lite with a "reverse bevel with step" edge profile 100*c* and a flat bottom substrate 3 in accordance with certain example embodiments, FIG. 22 shows a top lite with a "reverse bevel with step" edge profile 100*c* and a bottom lite that has a "flat with step" edge profile 100*a* in accordance with certain example embodiments, and FIG. 23 shows an example arrangement in which both the top and bottom lites have a "reverse bevel with step" edge profile 100*c* in accordance with certain example embodiments. It will be appreciated that the setbacks for the lites shown in FIGS. 22-23 may be the same or different in certain example embodiments. Additionally, it will be appreciated that the bevel angles in FIG. 23 may be the same or different in certain example embodiments. And, as above, the lites in each of FIGS. 21-23 may be interchanged, e.g., such that the top lites illustrated in the examples are the bottom lites in yet further examples, and vice versa.

As shown in these example VIG assemblies, the frit is provided at the edge portions thereof. It thus will be appreciated that the protrusion or shoulder portion of a substrate may be formed along the periphery of the substrate, or at least occupy a substantial portion of the periphery of the substrate, in certain example embodiments.

It will be appreciated that the example embodiments described herein may be used in connection with a variety of different VIG assembly and/or other units or components. For example, the substrates may be glass substrates, heat strengthened substrates, tempered substrates, etc.

The terms "heat treatment" and "heat treating" as used herein mean heating the article to a temperature sufficient to enabling thermal tempering, bending, and/or heat strengthening of the glass. This includes, for example, heating an article to a temperature of at least about 580 or 600 degrees C. for a sufficient period to enable tempering and/or heat strengthening, more preferably at least about 600 degrees C., and sometimes to 625 degrees C. In some instances, the HT may be for at least about 4 or 5 minutes.

It is noted that the glass substrate(s) may be heat treated in certain example embodiments so that the glass substrate(s) is/are either heat strengthened or thermally tempered (e.g., at a temperature of at least about 580 degrees C., more preferably at least about 600 degrees C., and often at least about 620 or 640 degrees C.).

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A vacuum insulated glass (VIG) unit, comprising:

first and second substantially parallel spaced apart substrates, and an evacuated cavity being provided between the first and second substrates; and an edge seal located around the periphery of the first and second substrates;

wherein the first substrate, when viewed along a side cross-section, comprises:

a body portion, a step portion extending a step height H into the cavity from a major axis of the body portion, an outer edge of the step portion extending away from the cavity at a right angle relative to a major inner surface of the first substrate and being offset at least a setback distance S from an outer edge of the VIG unit, and at least one protrusion extending from the outer edge of the step portion towards one edge of the VIG unit, the length of the protrusion corresponding to the setback distance S, and wherein a surface of the protrusion facing the second substrate is oriented at an oblique angle A1 relative to the outer edge of the step portion.

2. The VIG unit of claim 1, wherein the surface of the protrusion facing the second substrate is angled so that it extends away from the second substrate.

3. The VIG unit of claim 1, wherein the surface of the protrusion facing the second substrate is angled so that it extends toward from the second substrate.

4. The VIG unit of claim 1, wherein the angle A1 is from about 30-60 degrees.

5. The VIG unit of claim 1, further comprising a plurality of support pillars located in the cavity.

6. The VIG unit of claim 1, wherein the step height H is less than 50% the height of the body portion.

7. The VIG unit of claim 1, wherein the second substrate is dissimilar to the first substrate in that the second substrate does not include a step portion extending away from the cavity at a right angle relative to a major inner surface of the second substrate.

* * * * *